US008915454B2

(12) United States Patent
Churchill

(10) Patent No.: US 8,915,454 B2
(45) Date of Patent: Dec. 23, 2014

(54) DRINKING STRAWS HAVING ENVIRONMENTALLY-FRIENDLY WRAPPERS AND METHODS THEREFOR

(76) Inventor: Scott E. Churchill, Hackettstown, NJ (US)

( * ) Notice: Subject to any disclaimer, the term of this patent is extended or adjusted under 35 U.S.C. 154(b) by 442 days.

(21) Appl. No.: 13/026,363

(22) Filed: Feb. 14, 2011

(65) Prior Publication Data

US 2012/0205463 A1 Aug. 16, 2012

(51) Int. Cl.

| | |
|---|---|
| ***A47G 21/18*** | (2006.01) |
| ***A61G 15/00*** | (2006.01) |
| ***B65D 75/30*** | (2006.01) |

(52) U.S. Cl.

CPC ..... *A47G 21/188* (2013.01); *A47G 21/18* (2013.01); *B65D 75/30* (2013.01)

USPC ..... 239/33; 239/16; 229/103.1; 220/705

(58) Field of Classification Search

CPC ... A47G 21/18; A47G 21/181; A47G 21/182; A47G 21/183; A47G 21/184; A47G 21/185; A47G 21/186; A47G 21/187; A47G 21/188; A47G 21/189; B65D 75/30; B65D 81/36

USPC ..... 239/33; 229/103.1; 220/705

See application file for complete search history.

(56) References Cited

U.S. PATENT DOCUMENTS

| | | | | |
|---|---|---|---|---|
| 2,901,357 | A * | 8/1959 | Epstein | 426/85 |
| 3,957,202 | A * | 5/1976 | Hornsby, Jr. | 239/33 |
| 5,722,219 | A * | 3/1998 | Dobransky | 53/461 |
| 5,785,171 | A * | 7/1998 | Howes | 206/232 |
| 7,584,900 | B2 | 9/2009 | White et al. | |
| 2002/0092919 | A1 | 7/2002 | Campagna | |
| 2004/0182461 | A1 | 9/2004 | Margetson | |
| 2004/0256015 | A1 | 12/2004 | Margetson | |
| 2006/0027675 | A1 | 2/2006 | Takeda | |
| 2006/0169791 | A1 * | 8/2006 | Taylor et al. | 239/33 |
| 2006/0175248 | A1 | 8/2006 | Raimondo et al. | |

* cited by examiner

*Primary Examiner* — Dinh Q Nguyen

(74) *Attorney, Agent, or Firm* — Doherty IP Law Group LLC

(57) ABSTRACT

A drinking straw includes a tube having an upper end including a first opening, a lower end including a second opening, and an outer wall extending between the upper and lower ends. A wrapper covers the tube and a securing element permanently attaches the wrapper to the outer wall of the tube. The wrapper is adapted to be opened for exposing the first and second openings of the tube while the securing element maintains the attachment of the wrapper to the tube. The outer wall of the tube has an inner surface, whereby at least two opposing sections of the inner surface of the outer wall are joined together for forming a bifurcated opening adjacent an end of the tube. The bifurcated opening defines a total area that is smaller than the area of the opening at the opposite end of the tube.

15 Claims, 6 Drawing Sheets

DRINKING STRAWS HAVING ENVIRONMENTALLY-FRIENDLY WRAPPERS AND METHODS THEREFOR

FIELD OF THE INVENTION

The present invention generally relates to drinking straws, and more specifically relates to drinking straws having environmentally-friendly wrappers and integrated filtering elements.

BACKGROUND OF THE INVENTION

Description of the Related Art

Drinking straws are used for drawing liquids from containers, such as drinking glasses and bottles. In many instances, drinking straws have outer wrappers that are removed prior to using the straws for maintaining the sanitary condition of the straws. Unfortunately, after removing the outer wrapper, many individuals carelessly discard the wrapper so that it becomes litter. For example, if an individual at a beach removes the wrapper from a drinking straw and does not place the wrapper in a sealed container, the wrapper may blow away and become litter on the beach.

Another problem with conventional drinking straws is that obstructing elements, such as seeds or pits, may be drawn through an opening at the end of the drinking straw immersed in a liquid. This may cause the straw to become clogged or result in a user accidently ingesting a seed or pit.

There have been many attempts directed to providing filters for drinking straws. For example, U.S. Patent Application Publication No. 2002/0092919 to Campagna teaches a filtered drinking straw having a tube with a filtering apparatus affixed to either end of the tube. The filtering apparatus includes a laterally extending strap that extends across an opening at either end of the tube for preventing undesirable objects from entering the tube.

U.S. Patent Application Publication No. 2004/0182461 to Margetson discloses a drinking straw including an elongated metal tube provided with a plurality of perforations at one end which filter particles present in a liquid when the inserted lower end of the tube is pressed vertically on the bottom of a drinking container.

U.S. Patent Application Publication No. 2006/0027675 to Takeda discloses a perforated straw having a tubular body that is sealed at one end, with perforations in the body near the lower sealed end. The perforations allow for fluid to pass into the straw while preventing the passage of solids present in the beverage. The size and configuration of the perforations determines which, if any, solids pass through the straw and which remain within the beverage container.

U.S. Patent Application Publication No. 2006/0175248 to Raimondo et al. discloses a fluid filtering straw including a cylindrical elongated tube having a first end and an opposite second end, the first end being capable of being received within a consumer's mouth for suction and the second end leading to an expanded filtering section perpendicular to the cylindrical elongated tube to form an inverse T structure. The filtering section has at least two walls with a plurality of perforations formed therein to filter particles of a pre-determined size in the fluid through the plurality of perforations and allow the fluid to pass through an elongated tubular glass filtering structure for consumption.

In spite of the above advances, there remains a need for a drinking straw having an environmentally-friendly wrapper that remains permanently attached to the drinking straw after the wrapper has been opened. There also remains a need for a drinking straw having a filtering element that may be efficiently formed at a lower end of a straw without requiring an extra element to be attached to the lower end of the straw and without requiring expensive processing equipment for making a filtered drinking straw.

SUMMARY OF THE INVENTION

In one embodiment, a drinking straw preferably includes a tube, such as a paper, plastic, or polymer tube, having an upper end including a first opening, a lower end including a second opening, and an outer wall extending between the upper and lower ends of the tube. In one embodiment, the outer wall has a cylindrical shape. The straw desirably includes a wrapper, such as a paper, plastic or polymer wrapper, adapted to cover the tube, and a securing element, such as a mass of an adhesive or glue, used for permanently attaching the wrapper to the outer wall of the tube.

In one embodiment, the wrapper is preferably opened, such as by peeling or tearing the wrapper, for exposing the first and second openings of the tube for using the straw. As the wrapper is torn or peeled away for opening the straw, the securing element preferably maintains the permanent attachment of the wrapper to the outer wall of the tube.

In one embodiment, the outer wall of the tube preferably has an inner surface, whereby at least two opposing sections of the inner surface of the outer wall are joined together for forming a bifurcated opening adjacent an end of the tube. In one embodiment, the bifurcated opening is formed adjacent an end of the tube that is inserted into a liquid, such as a lower end of the tube. The bifurcated opening desirably has a first half opening and a second half opening. In one embodiment, the first and second half openings of the bifurcated opening preferably define a combined area that is smaller than the area of the first opening adjacent the upper end of the tube.

In one embodiment, a method of using a drinking straw having an environmentally-friendly wrapper includes providing a drinking straw having a tube with an upper end having a first opening, a lower end having a second opening, and an outer wall extending between the upper and lower ends of the tube. The method desirably includes covering the tube with a wrapper, and using a securing element for permanently attaching the wrapper to the outer wall of the tube.

In one embodiment, the method desirably includes opening the wrapper, such as by peeling or tearing the wrapper, for exposing the first and second openings of the tube, whereby the securing element desirably maintains the permanent attachment of the wrapper to the outer wall of the tube after the wrapper has been opened. In one embodiment, the securing element may be seated atop a rim of a liquid container so that one of the upper and lower ends of the tube is disposed inside the liquid container and the opened wrapper is located outside the liquid container. Thus, the securing element may be used for holding the straw in place within the liquid container and balancing and/or stabilizing the straw adjacent the rim of the liquid container.

In one embodiment, a drinking straw preferably includes a tube having an upper end including a first opening, a lower end including a second opening, and an outer wall extending between the upper and lower ends of the tube. The outer wall of the tube preferably has an inner surface with at least two opposing sections of the inner surface of the outer wall being joined together for forming a bifurcated opening adjacent the lower end of the tube. In one embodiment, three or more sections of the inner surface of the outer wall may be permanently joined together for forming a reduced diameter opening adjacent an end of the tube. The reduced diameter opening preferably filters obstructions present in a liquid, such as seeds and pits, as the liquid is drawn into the straw.

These and other preferred embodiments of the present invention will be described in more detail below.

DETAILED DESCRIPTION

Figure 1:
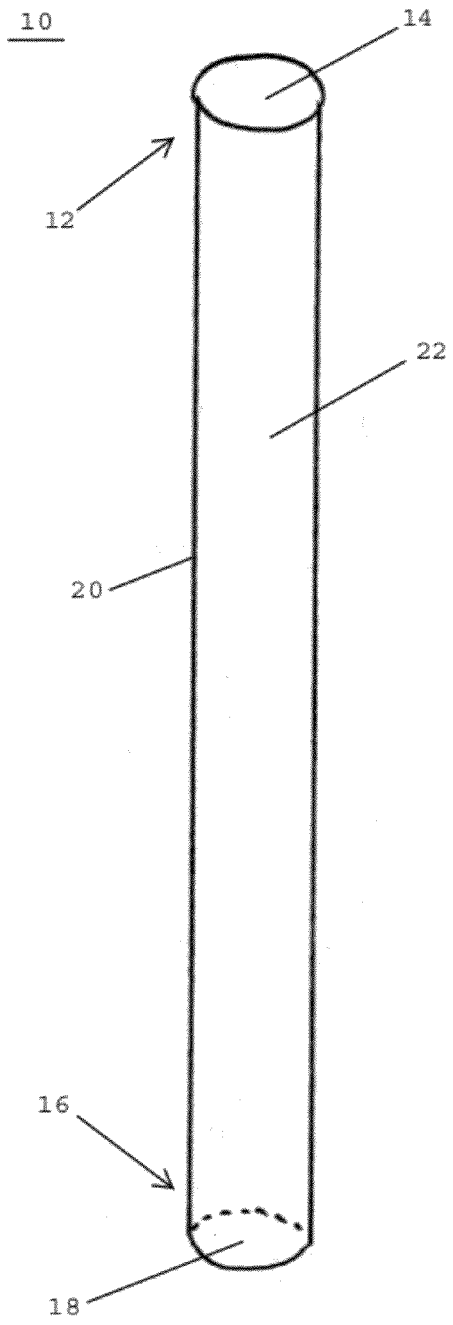
FIG. 1 Prior Art
FIG. 1 shows a prior art drinking straw.

FIG. 1 shows a conventional drinking straw 10 including an upper end 12 having a first opening 14 and a lower end 16 having a second opening 18. The drinking straw 10 includes a cylindrical outer wall 20 that extends between the first opening 14 and the second opening 18. The cylindrical outer wall 20 has a central conduit 22 that extends from the first opening 14 adjacent the upper end 12 of the straw to the second opening 18 adjacent the lower end 16 of the straw.

In use, the lower end 16 of the straw 10 is immersed in a liquid for drawing the liquid into the second opening 18, through the central conduit 22 and through the first opening 14. An individual may suck on the upper end 12 of the straw 10 for drawing the liquid into the second opening 18 and through the central conduit 22 toward the upper end 12 of the straw 10.

Often, conventional straws, such as the straw shown in FIG. 1, have an outer wrapper that maintains the sanitary condition of the straw during storage and prior to use. When an individual desires to use the straw, the wrapper is removed for exposing the straw for use. One problem with conventional drinking straw wrappers is that the opened wrapper becomes waste that must be placed into a refuse container such as a garbage can. Unfortunately, some individuals will not place the opened wrapper in a refuse container so that the wrapper will be discarded on a table top or on the ground whereupon it becomes litter.

Figure 2:
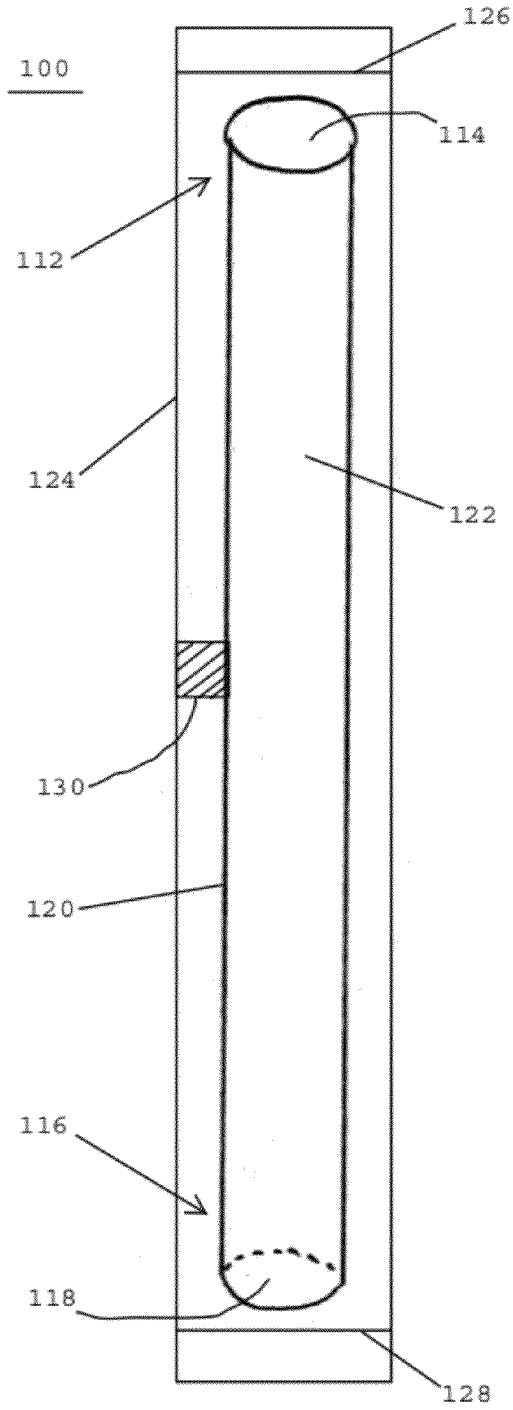
FIG. 2 shows a drinking straw having a wrapper attached thereto, in accordance with one embodiment of the present invention.

Referring to FIG. 2, in one embodiment, an environmentally-friendly drinking straw 100 preferably includes an upper end 112 having a first opening 114 and a lower end 116 having a second opening 118. The drinking straw 100 desirably includes an outer wall 120 having a cylindrical or tubular shape. The outer wall 120 surrounds a central conduit 122 that extends between the first opening 114 and the second opening 118. The drinking straw 100 desirably includes a wrapper 124 having a first seal 126 adjacent an upper end thereof and a second seal 128 adjacent a lower end thereof for sealing the straw 100 within the wrapper 124. The wrapper 124 may be made from a wide range of materials including paper, plastic, and polymers.

In one embodiment, the drinking straw 100 desirably includes a securing element 130 that secures or attaches the wrapper 124 to the outer wall 120 of the drinking straw 100. In one embodiment, the securing element 130 desirably forms a permanent connection between the outer wall 120 of the drinking straw and the wrapper 124 so that when the wrapper is opened for using the drinking straw, the wrapper 124 remains attached to the drinking straw so that it will not become litter. In one embodiment, the securing element 130 is an adhesive material.

Figure 3:
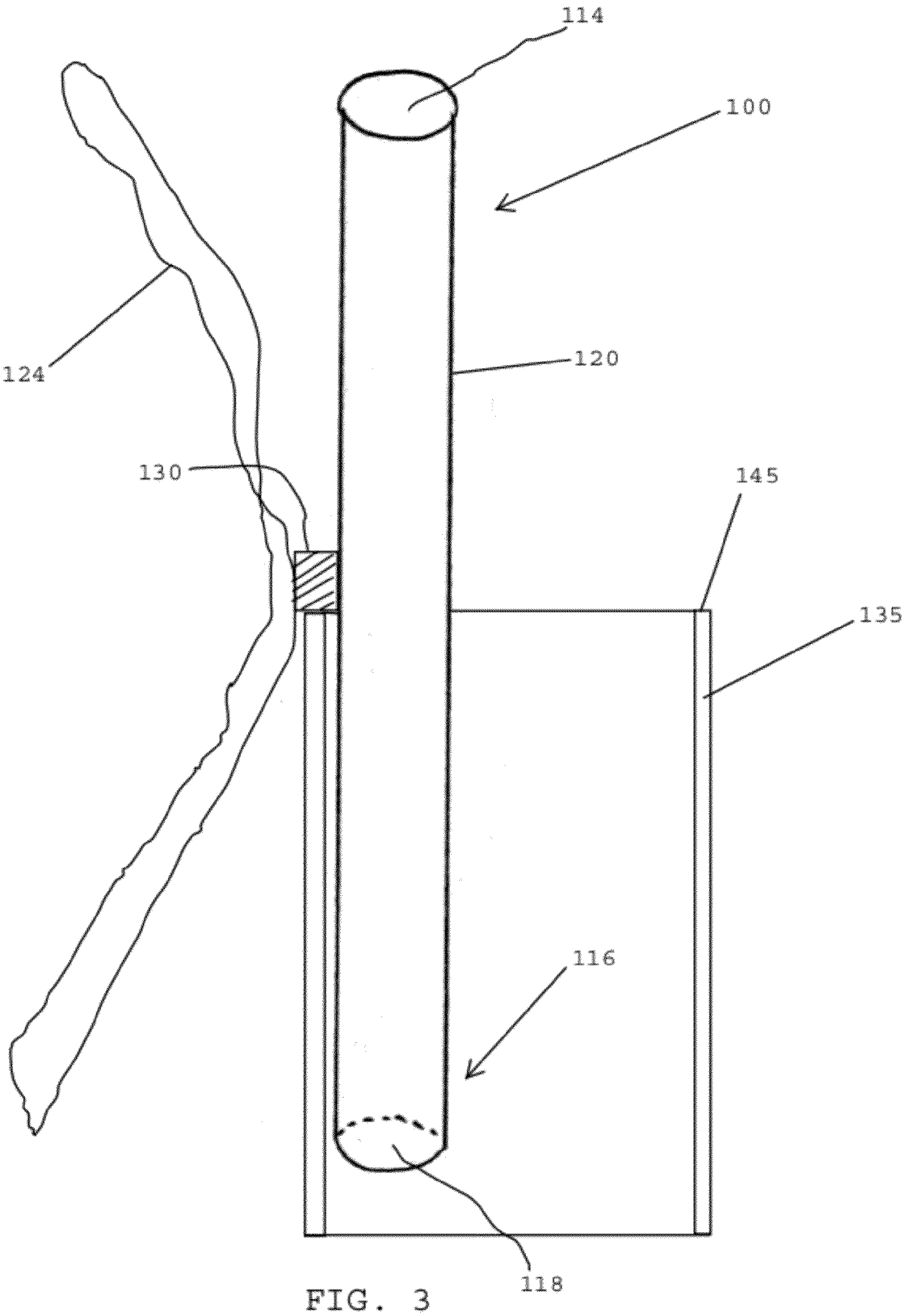
FIG. 3 shows the drinking straw of FIG. 2 after the wrapper has been opened for using the straw, in accordance with one embodiment of the present invention.

Referring to FIG. 3, in one embodiment, the wrapper 124 is preferably opened for exposing the first opening 114 at the upper end of the straw 100 and the second opening 118 at the lower end of the straw. As such, the second opening 118 may be immersed in a liquid container 135 for drawing a liquid through the straw 100. The securing element 130 desirably maintains the wrapper 124 attached to the outer wall 120 so that the wrapper 124 does not blow away and become uncollected waste or litter. The securing element 130 may be seated atop an upper rim 145 of the liquid container 135 so that the lower end 116 of the straw 100 is located inside the container 135 and the wrapper 124 is located outside the container 135. The securing element 130 may be used for balancing and/or stabilizing the straw adjacent the rim 145 of the container 135.

The drinking straw 100 shown in FIGS. 2 and 3 is environmentally-friendly, inter alia, because the wrapper 124 is designed to remain permanently attached to the outer wall 120 of the straw 100 so that it does not become litter. When an individual is done using the straw, the individual will place both the straw 100 and the wrapper 124 attached thereto in a refuse container so that both the straw and the wrapper are disposed of together. The environmentally-friendly drinking straw 100 of FIGS. 2 and 3 ensures that the wrapper is always thrown away when the straw is thrown away, and makes the straw more efficient to use because an individual does not have to handle a separate wrapper after the wrapper is opened for using the straw.

Referring to FIG. 3, in one embodiment, the securing element 130 that holds the wrapper 124 to the outer wall 120 of the straw 100 may be seated atop the rim 145 of the liquid container 135 for holding the straw 100 inside the container. For example, the securing element 130 may sit atop the rim of a drinking glass with the lower end 116 and second opening 118 of the straw 100 located inside the container and the wrapper 124 located outside the drinking glass.

Figure 4:
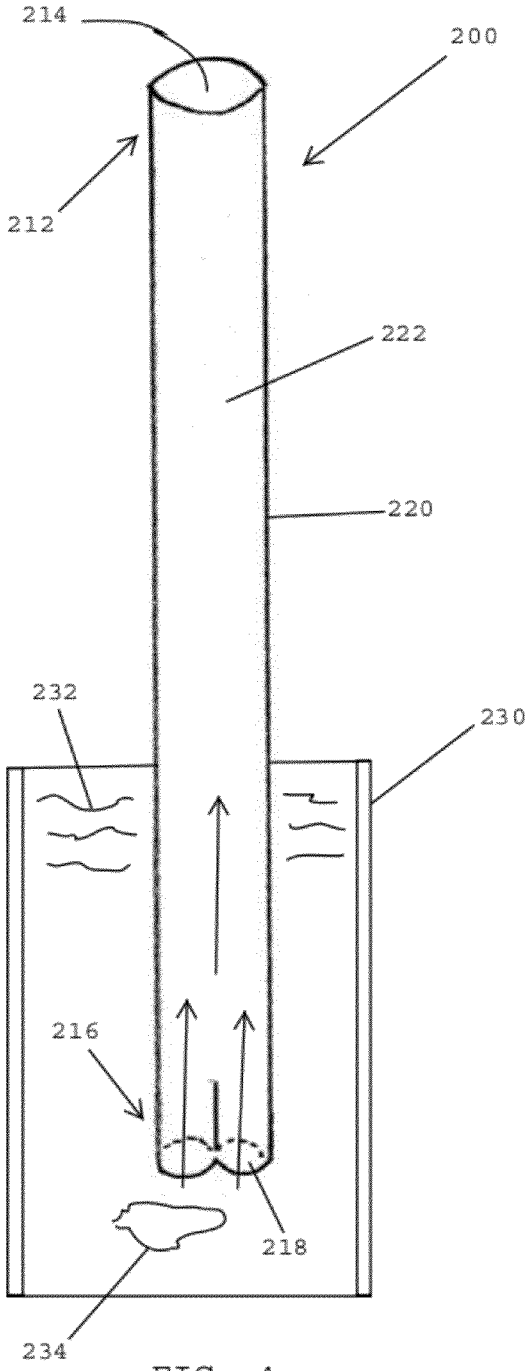
FIG. 4 shows a drinking straw having a bifurcated opening at a lower end thereof immersed in a liquid container, in accordance with one embodiment of the present invention.

Referring to FIG. 4, in one embodiment, a drinking straw 200 preferably has an upper end 212 with a first opening 214 and a lower end 216 with a second bifurcated opening 218. The drinking straw 200 desirably includes an outer wall 220 having a cylindrical or tubular shape defining a central conduit 222 that extends between the first opening 214 and the second bifurcated opening 218. The lower end 216 of the straw 200 is insertable into a drinking container 230 having a liquid 232 therein. The liquid may include objects such as seeds or pits 234 that should not be drawn into the drinking straw 200. In one embodiment, the second bifurcated opening 218 preferably includes two smaller openings that do not enable seeds or pits 234 present in the liquid 232 to pass therethrough. As a result, the seeds or pits 234 may not be drawn through the central conduit 222 of the straw 200 for obstructing the central conduit or being accidently ingested by an individual. Thus, the drinking straw 200 shown in FIG.

4 provides a number of benefits including preventing accidental ingestion of seeds, preventing an obstruction such as a pit 234 from being drawn into the lower end 216 of the drinking straw, and enhancing the drinking experience for an individual by minimizing anxiety concerning possibly drawing a seed or pit through the opening at the lower end 216 of the straw 200.

Figure 5:
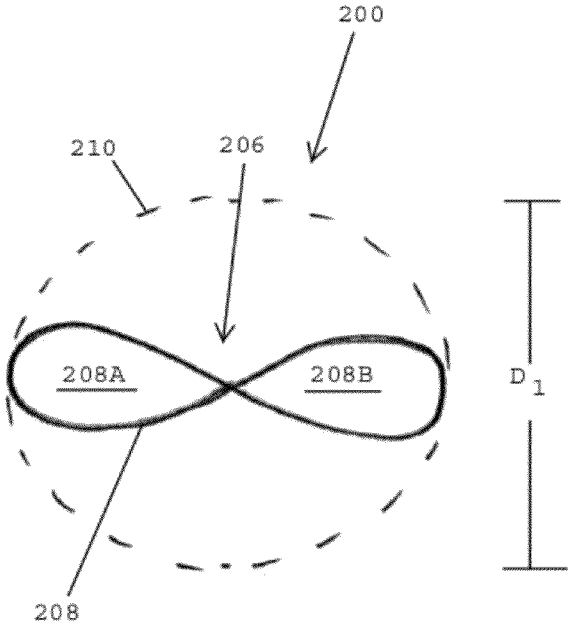
FIG. 5 shows the bifurcated opening at the lower end of the drinking straw shown in FIG. 4.

Referring to FIG. 5, in one embodiment, the lower end 206 of the straw 200 includes the bifurcated opening 208 including a first half opening 208A and a second half opening 208B. The bifurcated opening is desirably formed by sealing at least two opposing inner surfaces of the outer wall 220 together.

FIG. 5 shows the normal diameter $D_1$ of the outer wall 210 of the drinking straw 200, which extends along most of the length of the straw 200. However, near the lower end 206 of the straw 200, the opposing inner surfaces of the outer wall 210 are permanently joined together for forming the first and second half openings 208A, 208B of the bifurcated opening 208. As shown in FIG. 5, the first and second half openings 208A, 208B are substantially smaller in size than the size of the central conduit adjacent the upper end of the straw. The smaller bifurcated openings 208A, 208B preferably filter objects such as pits or seeds for preventing these objects from being drawn into the lower end 206 of the straw for avoiding the problems disclosed herein.

Figure 6A:
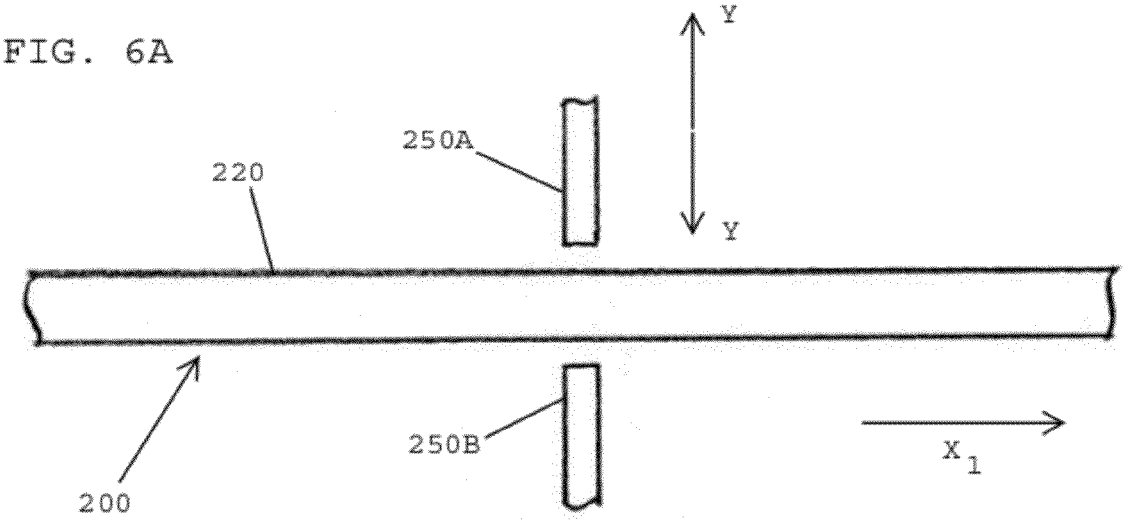
FIGS. 6A and 6B show a method of making a drinking straw having a bifurcated opening, in accordance with one embodiment of the present invention.
Figure 6B:
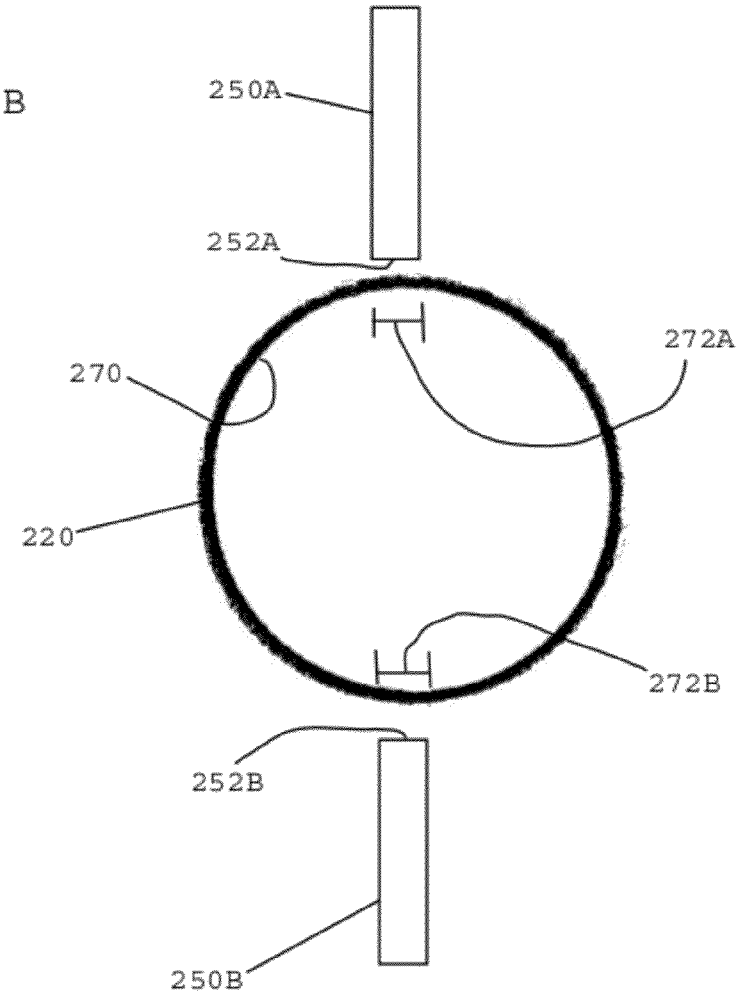

Referring to FIGS. 6A and 6B, in one embodiment, an extruded tubular element 200 is moved downstream by a conveying element in a direction designed $X_1$. The tubular element 200 is passed between an opposing pair of clamping elements 250A, 250B. The clamping elements 250A, 250B desirably include opposing end faces 252A, 252B that may be closed toward one another along an axis designated Y. The first and second opposing clamping elements 250A, 250B are adapted to reciprocate toward and away from one another along the axis Y for pinching together opposing sections of the inner surface of the outer wall 220 of the tubular element 200. In one embodiment, the clamping elements 250A, 250B may be heated for thermally sealing together the opposing inner surfaces of the outer wall 220 of the tubular element 200.

Referring to FIG. 6B, in one embodiment, the outer wall 220 has an inner surface 270 with opposing sections 272A, 272B. The clamping elements 250A, 250B are adapted to press the opposing sections 272A, 272B of the inner surface 270 together for permanently sealing and joining the opposing sections 272A, 272B together to form a bifurcated opening such as the bifurcated opening of FIG. 5.

Figure 7A:
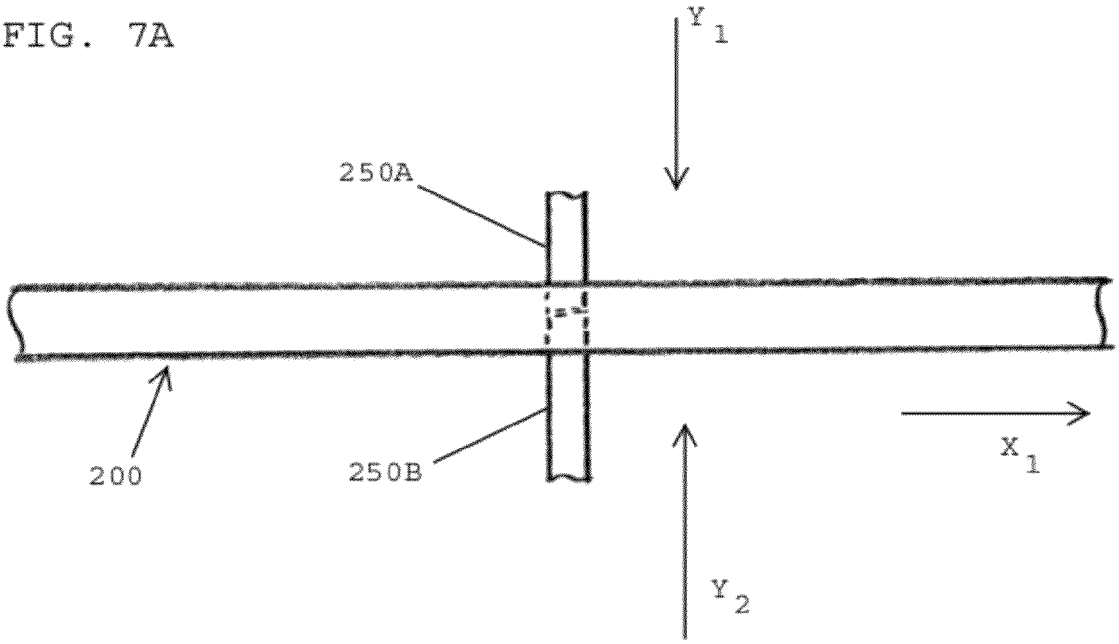
FIGS. 7A and 7B show a second stage of a method of making a drinking straw having a bifurcated opening, in accordance with one embodiment of the present invention.
Figure 7B:
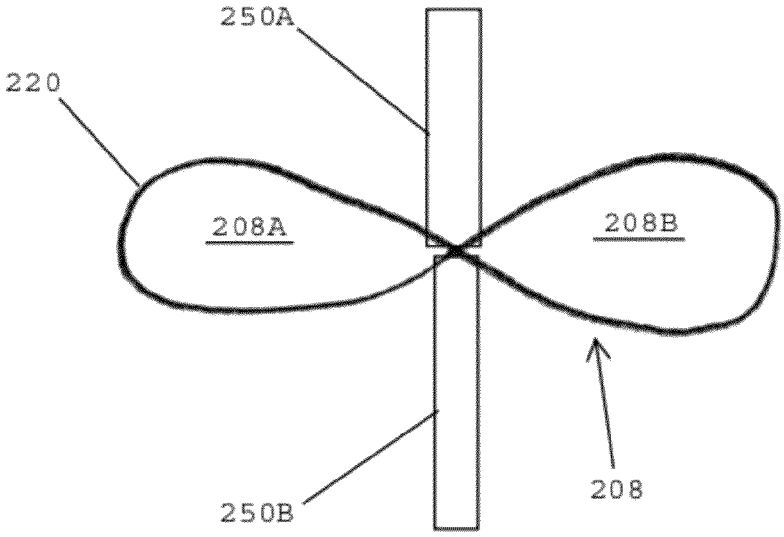

Referring to FIGS. 7A and 7B, in one embodiment, the first clamping element 250A is moved in the direction $Y_1$ and the second clamping element 250B is moved in the opposite direction $Y_2$ for pinching the outer wall 220 of the tubular element 200 therebetween. As the outer wall 220 is pinched together, the opposing sections of the inner surface of the outer wall are sealed together to form the bifurcated opening 208 including the first section 208A and the second section 208B (FIG. 5). Heat, energy, and/or friction may be applied though the clamping elements 250A, 250B for forming the seal.

In one embodiment, as the tubular element 200 moves in the direction $X_1$, the first and second clamping elements 250A, 250B repeatedly open and close in a reciprocating manner for pinching the outer wall 220 of tubular element together. As a result, a plurality of pinched sections are formed along the length of the tubular element 200.

Figure 8:
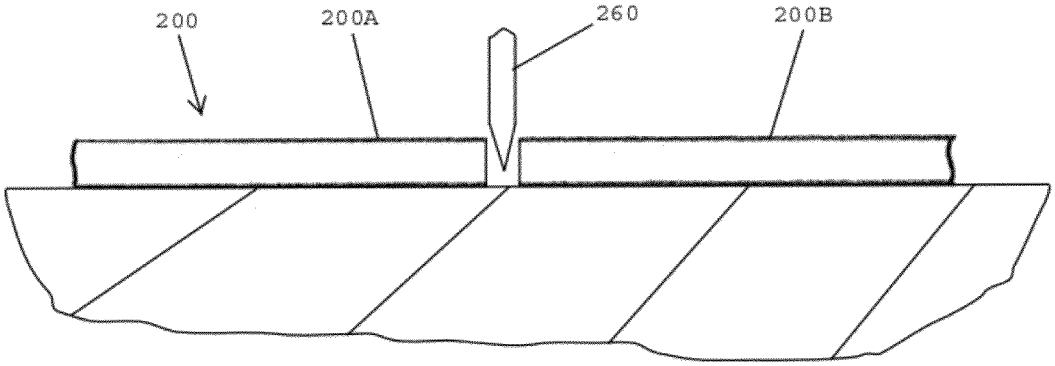
FIG. 8 shows a method of separating drinking straws having bifurcated openings, in accordance with one embodiment of the present invention.

Referring to FIG. 8, in one embodiment, after the tubular element 200 has been pinched to form the bifurcated openings as described above, a cutting tool 260 may be used for cutting the tubular element 200 into a plurality of separate drinking straws designated 200A, 200B, etc.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A drinking straw comprising:

a tube having an upper end including a first opening, a lower end including a second opening, and an outer wall extending between said upper and lower ends of said tube;

a wrapper adapted to cover said tube, wherein said wrapper has an unopened state in which said first and second openings are covered by respective upper and lower ends of said wrapper and an opened state in which said respective upper and lower ends of said wrapper are peeled away from said upper and lower ends of said tube for exposing said first and second openings for using said straw;

a securing element for permanently attaching said wrapper to said outer wall of said tube so that said wrapper remains attached to said tube after said wrapper is opened, wherein said securing element comprises a single mass of an adhesive or glue that is located between said upper and lower ends of said tube.

2. The drinking straw as claimed in claim 1, wherein when in the unopened state said wrapper has a first seal that covers said first opening at said upper end of said tube and a second seal that covers said second opening at said lower end of said tube, and wherein said wrapper is opened for exposing said upper and lower ends of said tube and said first and second openings of said tube while said single mass of an adhesive or glue maintains the permanent attachment of said wrapper to said outer wall of said tube.

3. The drinking straw as claimed in claim 1, wherein said wrapper is made of materials selected from the group consisting of paper, plastic and polymers.

4. The drinking straw as claimed in claim 1, wherein said single mass of an adhesive or glue attaches a mid-section of said tube with said wrapper.

5. The drinking straw as claimed in claim 1, wherein said tube comprises a material selected from the group consisting of paper, plastic and polymers.

6. The drinking straw as claimed in claim 1, wherein said outer wall of said tube has an inner surface, and wherein at least two opposing sections of said inner surface of said outer wall adjacent said lower end of said tube are joined together for forming a bifurcated opening adjacent said lower end of said tube.

7. The drinking straw as claimed in claim 6, wherein said bifurcated opening has a first half and a second half.

8. The drinking straw as claimed in claim 7, wherein said first and second halves of said bifurcated opening define a combined area that is smaller than the area of said first opening adjacent said upper end of said tube.

9. A method of using a drinking straw having an environmentally-friendly wrapper comprising:

providing a drinking straw including a tube having an upper end with a first opening, a lower end with a second opening, and an outer wall extending between said upper and lower ends of said tube;

covering said tube with a wrapper having a first seal adjacent an upper end of said wrapper and adiacent said upper end of said tube and a second seal adjacent a lower end of said wrapper and adiacent said lower end of said tube so that said first and second openings are covered by said wrapper;

peeling said wrapper away from said upper and lower ends of said tube and said first and second openings for exposing said first and second openings for using said straw;

using a securing element for permanently attaching said wrapper to said outer wall of said tube, wherein said securing element is located between said upper and lower ends of said tube.

10. The method as claimed in claim 9, wherein said securing element comprises a single mass of an adhesive or glue that maintains the permanent attachment of said wrapper to said outer wall of said tube after said upper and lower ends of said wrapper have been peeled away from said upper and lower ends of said tube by connecting a mid-section of said tube with said wrapper, wherein said mid-section of said tube is spaced away from said upper and lower ends of said tube.

11. The method as claimed in claim 10, further comprising:

seating said single mass of said adhesive or glue atop a rim of a liquid container so that one of said upper and lower ends of said tube is disposed inside said liquid container and said opened wrapper is located outside said liquid container with said single mass of an adhesive or glue extending over said rim from the inside of said liquid container to the outside of said liquid container.

12. A drinking straw comprising:

a tube having an upper end including a first opening, a lower end including a second opening, and an outer wall extending between said upper and lower ends of said tube;

a wrapper adapted to cover said tube, wherein said wrapper has a first seal adjacent an upper end thereof for covering said first opening at said upper end of said tube and a second seal adjacent a lower end thereof for covering said second opening at said lower end of said tube, wherein said wrapper has an unopened state in which said first and second openings are covered by said wrapper and an opened state in which said wrapper is peeled away from said upper and lower ends of said tube and said first and second openings for exposing said first and second openings for using said straw;

a securing element for permanently attaching said wrapper to said outer wall of said tube so that said wrapper remains attached to said tube after said wrapper is opened by peeling said upper and lower ends of said wrapper away from said respective upper and lower ends of said tube, wherein said securing element consists of a single mass of material that is connected to said outer wall of said tube between said upper and lower ends of said tube.

13. The drinking straw as claimed in claim 12, wherein said single mass of material comprises an adhesive or glue.

14. The drinking straw as claimed in claim 13, wherein said single mass of an adhesive or glue connects a mid-section of said tube with said wrapper for permanently attaching said wrapper with said outer wall of said tube, wherein said single mass of an adhesive or glue is spaced away from said upper and lower ends of said tube.

15. The drinking straw as claimed in claim 14, wherein said single mass of an adhesive or glue connects a section of said wrapper located between said upper and lower ends of said wrapper and said first and second seals to said outer surface of said tube.

* * * * *